US005403035A

United States Patent [19]

Hamilton

[11] Patent Number: 5,403,035

[45] Date of Patent: Apr. 4, 1995

[54] PREPARING AIR BAG VEHICLE RESTRAINT DEVICE HAVING CELLULOSE CONTAINING SHEET PROPELLANT

[75] Inventor: Brian K. Hamilton, Littleton, Colo.

[73] Assignee: OEA, Inc., Aurora, Colo.

[21] Appl. No.: 891,830

[22] Filed: Jun. 1, 1992

[51] Int. Cl.[6] ..... C06B 45/12; B60R 21/26

[52] U.S. Cl. ..... 280/736; 102/251; 102/285; 149/14; 149/15; 149/13.7; 149/61; 280/741

[58] Field of Search ..... 149/19.7, 14, 15, 61; 280/741, 736; 102/284, 285

[56] References Cited

U.S. PATENT DOCUMENTS

| | | | |
|---|---|---|---|
| 478,844 | 7/1892 | Brown . | |
| 852,142 | 4/1907 | Sparre . | |
| 1,568,324 | 1/1926 | Dehn . | |
| 1,637,726 | 8/1927 | Bergeim . | |
| 1,671,792 | 5/1928 | Stoops . | |
| 1,819,456 | 8/1931 | Dehn . | |
| 1,831,760 | 11/1931 | Wieben . | |
| 2,991,168 | 7/1961 | Nadel . | |
| 3,139,355 | 6/1964 | De Fries et al. . | |
| 3,213,793 | 10/1965 | Dratz . | |
| 3,260,203 | 7/1966 | Godfrey et al. | 102/43 |
| 3,361,604 | 1/1968 | Griffith . | |
| 3,706,280 | 12/1972 | Bobuski et al. | 149/2 |
| 3,763,787 | 10/1973 | Schultz | 102/284 |
| 3,773,351 | 11/1973 | Catanzarite | 280/738 |
| 3,862,866 | 1/1975 | Timmerman et al. | 149/21 |
| 3,912,561 | 10/1975 | Doin et al. | 149/35 |
| 3,948,697 | 4/1976 | Flanagan et al. | 149/11 |
| 3,964,256 | 6/1976 | Plantif et al. | 60/219 |
| 3,971,729 | 7/1976 | Timmerman | 149/83 |
| 3,986,908 | 10/1976 | Grebert et al. | 149/19.7 |
| 4,068,589 | 1/1978 | Oversohl | 102/43 R |
| 4,214,438 | 7/1980 | Hamilton | 149/83 |
| 4,264,051 | 1/1981 | Garner et al. | 149/7 |
| 4,303,413 | 12/1981 | Marion . | |
| 4,386,979 | 6/1983 | Jackson, Jr. | 149/21 |
| 4,408,534 | 10/1983 | Arakai | 102/285 |
| 4,696,705 | 9/1987 | Hamilton | 149/21 |
| 4,734,141 | 3/1988 | Cartwright et al. | 149/35 |
| 4,759,885 | 7/1988 | Kurtz | 264/3.1 |
| 4,810,430 | 3/1989 | DeLuca | 264/3.3 |
| 4,890,860 | 1/1990 | Schneiter | 280/741 |
| 5,062,367 | 11/1991 | Hayashi et al. | 280/741 |
| 5,125,684 | 6/1992 | Cartwright | 280/741 |

FOREIGN PATENT DOCUMENTS

| | | | |
|---|---|---|---|
| 0474115A1 | 3/1990 | European Pat. Off. | C06B 35/00 |
| 0438851A2 | 7/1991 | European Pat. Off. | C06D 5/06 |
| 0482852A1 | 4/1992 | European Pat. Off. | C06D 5/06 |
| 2351401 | 5/1974 | Germany | C06D 5/06 |
| 535971 | 4/1941 | United Kingdom . | |
| WO86/02347 | 4/1986 | WIPO | C06B 31/28 |

*Primary Examiner*—Edward A. Miller
*Attorney, Agent, or Firm*—Sheridan Ross & McIntosh

[57] ABSTRACT

The present invention provides a cellulose-based propellant for generating gas to inflate an air bag in a vehicle occupant restraint system. In one embodiment, the propellant includes cellulose in combination with an alkali nitrate oxidizer, such a potassium nitrate, and Kaolinite clay for increasing the viscosity of the residue resulting from combustion of the propellant. Also included in the present invention is a method for producing the propellant and incorporating the propellant into an air bag restraint system. In one embodiment of the method, cellulose fiber in the form of pulp board or wood pulp is soaked in a solution that includes an oxidizing agent to produce a slurry, the slurry is then formed into a sheet of a desired density, the sheet is then at least partially dried, if required, and then formed into a desired shape for incorporation into a vehicle restraint system that employs an air bag.

20 Claims, 2 Drawing Sheets

PREPARING AIR BAG VEHICLE RESTRAINT DEVICE HAVING CELLULOSE CONTAINING SHEET PROPELLANT

BACKGROUND OF THE INVENTION

1. Field of the Invention

The present invention generally relates to vehicle occupant restraint systems that employ air bags. More specifically, the present invention relates to a propellant for producing nitrogen gas to inflate an air bag, a method for producing such a propellant, and an air bag vehicle occupant restraint system that utilizes the propellant.

2. Description of the Related Art

Generally, an air bag restraint system includes a reaction canister for containing a propellant that, when ignited, produces a gas that is used to inflate an air bag. To ignite the propellant, an igniter that is responsive to a signal provided by a collision sensor is disposed adjacent to the propellant. The air bag restraint system also includes an air bag that is located across an open end of the reaction canister. Located in the canister and between the air bag and the propellant is a filter for preventing the hot residues produced by combustion of the propellant from entering the air bag and possibly coming into contact with the occupant of the vehicle when the air bag is inflated. Briefly, operation of an air bag restraint system is initiated when the sensor detects an imminent collision or a collision and causes the igniter to ignite the propellant. Ignition of the propellant, in turn, produces gas to inflate the air bag and thereby prevent injuries to the occupant of the vehicle by restraining or inhibiting their movement. Shortly after inflation, the air bag deflates to permit the occupant to move and exit the vehicle if necessary.

Presently, the propellant most commonly used in air bag restraint systems includes sodium azide ($NAN_3$), which produces nitrogen gas for inflating the air bag when combusted. Propellants that incorporate sodium azide, upon combustion, produce a gaseous atmosphere of substantially 100% nitrogen gas for inflating the air bag. This is advantageous because nitrogen gas is substantially inert and can be inhaled by humans for short periods of time without harmful effects. The use of sodium azide does, however, present several drawbacks. Namely, sodium azide is a Class B poison and easily hydrolyzed into hydrazoic acid, which is also toxic and explosive. Moreover, sodium azide reacts with heavy metals, like copper and lead, to produce a very sensitive explosive that can be easily ignited. Due to these factors, substantial precautions are necessary in the transportation of sodium azide, its incorporation into air bag systems, and in its eventual disposal when the air bag system in which it is incorporated is discarded that add to the overall expense of such systems. For example, special precautions must be taken during transportation of the sodium azide to prevent leakage of this toxic and reactive material into the environment. Additionally, the air bag restraint systems that incorporate a sodium azide-based propellant require containers for the propellant that are designed to prevent the sodium azide from contacting heavy metals, becoming hydrolyzed, and from leaking into the occupant environment of the vehicle. Moreover, during disposal of air bag restraint systems that employ sodium azide as a propellant, further precautions must be taken to prevent the sodium azide from coming into contact with heavy metals or becoming hydrolyzed. These drawbacks are further compounded by the increasing demand for passenger side air bags in automobiles that deploy air bags with volumes three to four times that of the driver's side air bags and therefore, require proportionately greater amounts of sodium azide propellant.

A further drawback associated with the use of sodium azide-based propellants in air bag restraint systems is that the process for producing such propellants is a relatively complicated process that involves blending the sodium azide with a refractory oxidizer, such as iron oxide or copper oxide, pressing the resulting mixture into pellets, and then establishing channels in the pellets for conducting gas and for controlling the burn rate of the propellant. The complexity of producing sodium azide-based propellants, in turn, increases the expense of the resulting air bag vehicle restraint systems that incorporate such propellants.

Yet a further disadvantage of sodium azide-based propellants is that it is difficult to design and manufacture the propellant with a desired burn rate. As previously mentioned, one proposed solution to controlling the burn rate of sodium azide-based propellants has been to establish channels in the pellets. The establishment of channels in the pellets adds to the complexity as well as the expense of manufacturing the propellant. Another proposed solution to controlling the burn rate of sodium azide-based propellants has been to incorporate graphite fibers into the propellant. This also requires additional manufacturing steps and increases the expense of the resulting propellant. Moreover, the degree to which the burn rate can be regulated by these solutions has, in many cases, proven to be subject to unacceptable variation.

Another disadvantage of sodium azide-based propellants is that combustion of the propellant produces a molten sodium oxide ($Na_2O$) residue that is in the form of relatively small globules with low viscosity. The relatively small size of the globules and their low viscosity necessitate the use of "slagging" agents to increase the viscosity of the residue and a relatively expensive filter to be interposed between the propellant and the air bag to prevent the residue from entering the air bag and possibly burning the occupant of a vehicle in which the restraint system is employed.

Alternatives to sodium azide-based propellants have been developed that are derived from hydroxamine and hydroxylamine. Further, propellants using polymeric binders, hydrocarbons, carbohydrates, and dialkali salts of bitetrazole and azobitetrazole have also been developed. Many of these alternatives to sodium azide-based propellants have many of the same disadvantages as the sodium azide propellants or other disadvantages that have not made it worthwhile to convert from the sodium azide-based propellants.

Based on the foregoing, there is a need for a propellant for an air bag vehicle restraint system that reduces the use of sodium azide to, in turn, reduce the problems associated with the transportation of sodium azide, the incorporation of sodium azide into air bag restraint systems, and the subsequent disposal of air bag restraint systems that employ sodium azide. There is the further need for a propellant for use in air bag restraint systems that can be easily and inexpensively manufactured. Moreover, a propellant for air bag systems is needed in which the burn rate of the propellant can be readily controlled or regulated. Moreover, a propellant for air bag restraint systems is needed that, upon combustion, produces a residue that reduces the need for a complicated or expensive filtering mechanism to prevent molten material or other residue produced by combustion of the propellant from entering the air bag and possibly injuring an occupant of the vehicle in which the air bag restraint system is installed.

SUMMARY OF THE INVENTION

The present invention provides a propellant for use in producing gas to inflate an air bag in a vehicle occupant restraint system that, in one embodiment, includes fibrous cellulose, an oxidizing agent for reacting with the cellulose to produce a gas when the propellant is ignited, and a vitrifying agent for increasing the viscosity of the residue produced when the propellant is ignited. Among the suitable oxidizing agents are alkali metal nitrates, such as potassium nitrate, and alkali metal nitrites. Suitable vitrifying agents include alumina, silicon dioxide, boric oxide, and titanium oxide and various clays, e.g. Kaolinite (calcined or natural). This propellant has several advantages relative to many of the known propellants and especially sodium azide-based propellants that are used in air bag restraint systems. Namely, the constituents of this propellant are relatively safe to transport, readily incorporated into an air bag restraint system, and, once incorporated into an air bag restraint system, reduce the need for special or precautionary disposal techniques when the vehicle within which the restraint system is installed is retired. Further, the residue that results upon combustion of the propellant is of a relatively large size and a high viscosity that permits a relatively simple and inexpensive filter to be employed in the air bag restraint system relative to the filters that, for example, are employed in air bag systems that use sodium azide-based propellants.

Other embodiments of the propellant of the present invention include agents for increasing the yield of nitrogen gas and altering the composition of the gases produced by combustion of the propellant. For example, 1-Nitroguanidine or Cyanoguanidine can be included in the propellant to increase the production of nitrogen gas and thereby increase the amount of nitrogen gas relative to $CO_2$ and $H_2O$, which are also produced by combustion of the propellant. Yet further embodiments include agents for affecting the burn rate or rate at which gas is produced by the propellant. For example, the propellant can include potassium chlorate for increasing the burn rate of the cellulose and thereby increasing the rate at which gas is produced during combustion of the propellant.

Also provided by the present invention is a method for producing a propellant that includes fibrous cellulose and an oxidizing agent which is relatively simple and inexpensive. One embodiment of the process includes the steps of soaking the cellulose in a solution that contains the oxidizing agent to form a slurry; forming the slurry into a sheet in a conventional mat making machine, such as a Fourdrinier or cylinder former, calendaring the sheet to a desired thickness; at least partially drying the sheet; and then forming the sheet into the desired shape for incorporation into the air bag restraint system. This method of producing the propellant also provides good control over the porosity of the resulting propellant and hence the burn rate of the propellant upon combustion.

Also provided by the present invention is an air bag restraint device that employs a cellulose-based propellant and a method for making the device.

DETAILED DESCRIPTION OF AN EMBODIMENT OF THE INVENTION

Figure 1:
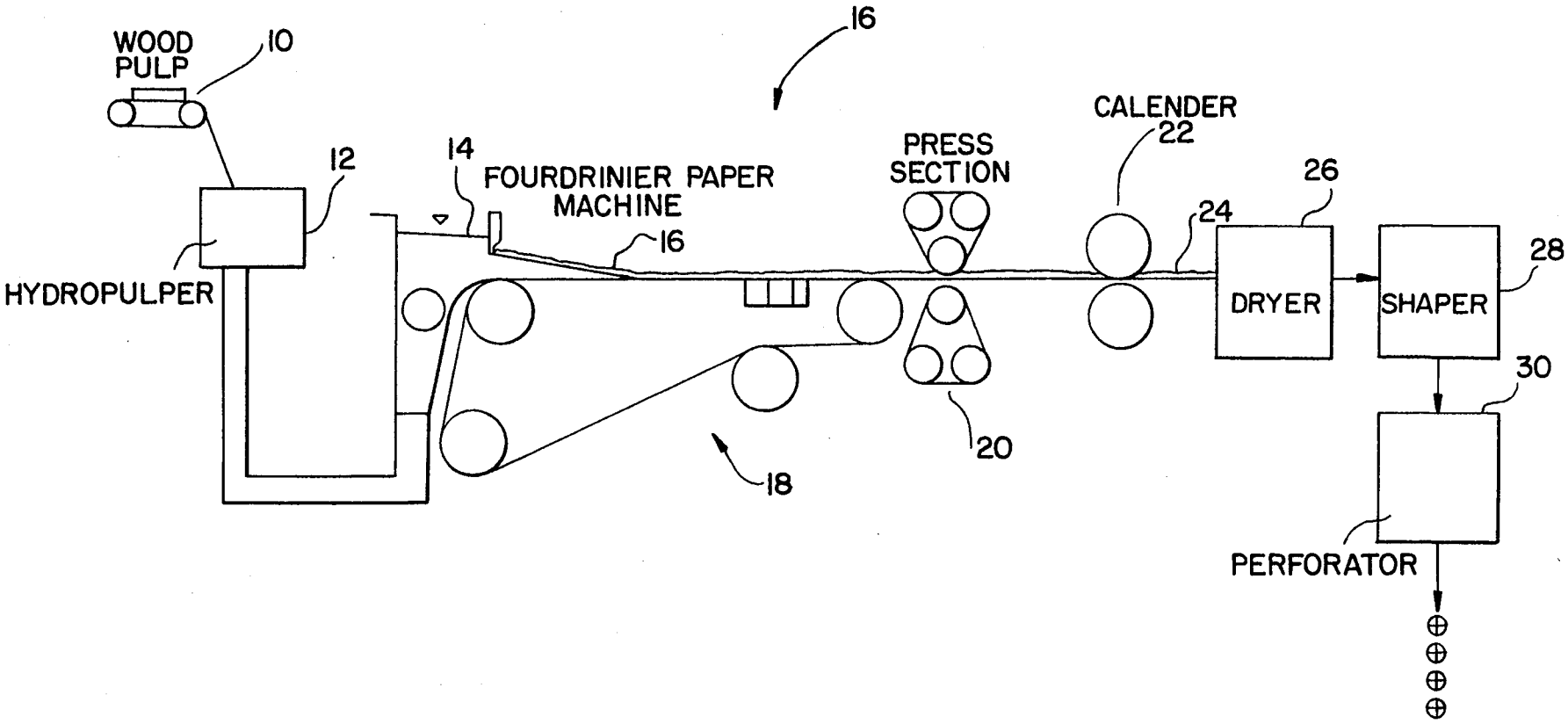
FIG. 1 illustrates the process or method for producing a propellant that includes cellulose and that is suitable for use in an air bag restraint system.

The present invention provides a propellant for use in producing gas to inflate an air bag in a vehicle occupant restraint system. The composition of the propellant includes fibrous cellulose for, upon combustion, producing gas to inflate an air bag. Presently, a plentiful and relatively inexpensive source of fibrous cellulose is pulp board or wood pulp. The propellant also includes an oxidizing agent for facilitating combustion of the cellulose material to produce the gas. Suitable oxidizing agents include alkali metal nitrates, such as potassium nitrate, and alkali metal nitrites. Also included in the propellant is a vitrifying agent for reducing filter requirements in the air bag restraint system by increasing the viscosity of the residue resulting from the reaction of the cellulose with the oxidizing agent. Among the known suitable vitrifying agents are aluminum oxide, boric oxide, silicon dioxide, titanium dioxide, and silicate clays, such as Kaolinite clay (calcined or natural), mullite, or mixtures thereof. A relatively inexpensive and readily available agent that is presently being used in one embodiment of the propellant is calcined Kaolinite clay, which includes aluminum oxide and silicon dioxide.

Presently, the relative proportions of the components of one formulation of the propellent are as follows:

potassium nitrate—66% by weight of the propellant;

cellulose—22% by weight of the propellant; and calcined Kaolinite clay—12% by weight of the propellant.

Combustion of the propellant produces the following gases: nitrogen, carbon dioxide, and $H_2O$. The relative proportions of these gases can be adjusted by altering the ratios of the cellulose, oxidizing agent, and vitrifying agent. Further, the relative composition of the gases produced by combustion of the propellant and the gas yield can be adjusted by including further ingredients in the propellant formulation. For example, the yield of nitrogen gas can be increased by the addition of 1-Nitroguanidine, Cyanoguanidine, or sodium azide to the formulation of the propellant. With respect to the inclusion of sodium azide in the propellant of the present invention, a small amount of sodium azide, typically less than 15% of the propellant by weight, can yield a relatively large increase in the nitrogen gas produced by the propellant upon combustion. Sodium azide also increase the burning rate of the propellant. This amount of sodium azide is much less than the sodium azide-based propellants in which the sodium azide is primary producer of nitrogen gas. In these propellants, the sodium azide typically accounts for 60% or more of the weight of the propellant. Consequently, formulations of the cellulose-based propellant of the present invention that include sodium azide have proportionately reduced the disadvantages associated with propellants that rely upon sodium azide as a producer of most, if not all, of the nitrogen gas for inflating air bags in a vehicle occupant restraint system.

The propellant can also include an agent for increasing the burn rate or rate at which the propellant produces gas. Typically, in passenger air bag restraint systems, the air bag must be inflated in 50 to 100 milliseconds to prevent injury to the occupant of the vehicle in the event of a collision. Consequently, the burn rate of the propellant employed in the air bag restraint system is of considerable concern. Agents for increasing the burn rate include sulfur and certain sulfur compounds. Other agents for increasing the reaction by, or to catalyze the burning of the propellant include alkali metal chlorates, such as potassium chlorate, which yield high burning rates at a relatively low combustion temperature.

The present invention also includes a method for producing a cellulose-based propellant for an air bag restraint system that is relatively simple, inexpensive, capable of continuous operation, adapts previously developed paper making equipment and provides good control over the porosity of the resulting propellant, which is an important factor in the burn rate of the resulting propellant. With reference to FIG. 1, the method of producing the propellant is now discussed. Initially, cellulose in the form of wood pulp 10 is input to a mixer 12 (i.e., hydropulper) that disperses the wood pulp 10 in a solution/suspension of an oxidizing agent, such as potassium nitrate or nitrite. The solution can also contain a residue vitrifying agent, an agent for increasing the gas production of the resulting propellant, or an agent for increasing the burn rate of the resulting propellant. As previously mentioned, the relative proportions of the constituents of the propellant can be adjusted to tailor the quantities of gas output by the propellant upon combustion. The mixer 12 combines the wood pulp 10 with the solution to produce a slurry 14 that is deposited onto a sheet making device 16 (e.g., a Fourdrinier paper making machine) at the desired mass per unit area.

The sheet making device 16 dewaters the slurry 14 to form a sheet 16 that is transported via a conveyor system 18 to a pressing section 20 that further consolidates and dewaters the sheet 16. After the pressing section 20, the sheet 16 is conveyed to a calendaring assembly 22 that forms the sheet 16 into a sheet 24 of a desired thickness and density. The ability to adjust the density of the sheet 24 is important because it is inversely related to the porosity of the propellant. Consequently, as the sheet 24 becomes more dense, the porosity of the sheet 24 decreases. The porosity of the propellant, in turn, affects the burn rate or rate at which the propellant produces gas after it is ignited. More specifically, the greater the porosity, the higher the burn rate of the propellant. Consequently, by controlling the density of the sheet 24, the burn rate of the propellant can be controlled or regulated. For example, if the sheet 24 produced by the roller assembly 20 is relatively dense, then the propellant will have a reduced burn rate relative to a less dense sheet of the propellant due to its reduced porosity.

The sheet 24 output by the calendar 22 is subsequently applied to a dryer 26 to remove a substantial portion of the moisture from the sheet 24. The semi-dry sheet 24 is then introduced to a shaper 28 that wraps or rolls the sheet into individual cylindrical or spirally shaped propellant units that are of a diameter which is suitable for insertion into a tubular-shaped propellant housing in an air bag restraint system. The shaper 28 can, however, be adapted to produce units of other shapes if required. The propellant units are subsequently applied to a perforator 30 that punches holes in the propellant units to reduce radial pressure gradients upon combustion of the propellant that may adversely affect the performance of the air bag restraint system. Much of the process described with reference to FIG. 1 can be implemented using paper processing technology, such as Fourdrinier paper processing machinery.

An alternative method for producing the propellant involves infusing the pulp board in a hot solution in which the oxidizing agent and any other desired agents are dissolved. After a sufficient amount of the solution has been absorbed by the pulp board, it is then cooled to crystallize the oxidizing agents and any other agents included in the solution in the pulp board. The infused pulp board can then be subjected to a drying operation, a shaping operation and, if necessary, a perforating operation.

Figure 2:
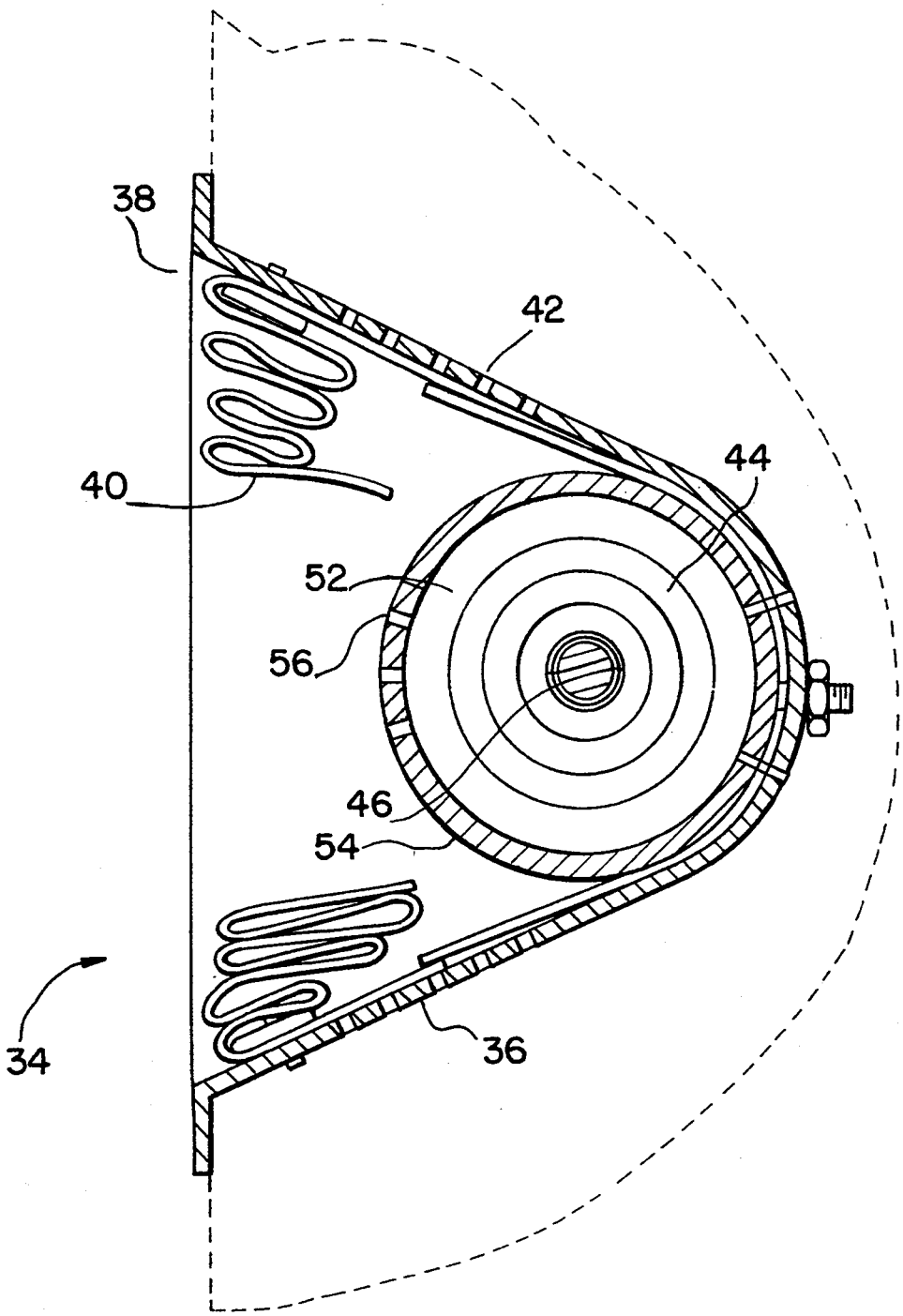
FIG. 2 is a cross-sectional view of a portion of an air bag restraint system that includes a cellulose-based propellant.

FIG. 2 illustrates an air bag restraint device 34 that includes a propellant formed by combining cellulose with a suitable oxidizing agent. The air bag restraint device includes a reaction canister 36 that has an open end 38 across which an air bag 40 is disposed and an interior 42 in which a cylindrically-shaped propellant 44 comprised of fibrous cellulose and potassium nitrate is housed. Positioned adjacent to the propellant 44 within the reaction canister 36 is an igniter or squib 46 that, in response to a signal from a sensor that detects a collision or imminent collision, ignites the propellant 44. The propellant 44 and the igniter 46 are disposed within a first cylindrical housing 48 that has a first plurality of openings 50 for venting the gases produced during combustion of the propellant 44. Surrounding the first cylindrical housing 48 is a filter 52 that prevent residue from the combustion of the propellant 44 from coming into contact with the air bag 40 and possibly the occupant of the vehicle in which the air bag restraint device 34 is mounted. Due to the relatively high viscosity of the residue produced by the propellant 44, the filter 52 can be made from relatively inexpensive mineral felt material and the use of complicated and/or expensive filters reduced. The filter 52 can also include wire mesh and/or perforated and/or expanded metal mesh, but to a lesser extent than the filters used in known air bag restraint devices. The ability to use such a filter can be further enhanced by including a vitrifying agent, such as Kaolinite clay, in the propellant 44 as previously mentioned. A second cylindrical housing 54 with a second plurality of openings for venting the gases produced by combustion of the propellant 44 houses the propellant 44, the igniter 46, the first cylindrical housing 48, and the filter 52. The air bag restraint device 34 is shown as being mounted to a dashboard 58. The reaction canister 36, the first cylindrical housing 48, and/or the second cylindrical housing 54 are made of materials, such as steel (crimped or welded.), that are capable of withstanding the heat and pressure produced during combustion of the propellant 44. If weight is a consideration, these components can also be made of lighter materials capable of withstanding the pressure stresses, like aluminum.

When the air bag restraint device 34 is in operation, a sensor (not shown) detects a collision or imminent collision of the vehicle with another object and generates a signal that is applied to the igniter 46. In response, the igniter 46 ignites the propellant 44, which then produces nitrogen, carbon dioxide, and $H_2O$ gases. These gases flow through the first plurality of openings 50 in the first cylindrical housing 48, pass through the filter 52, and then vent through the second plurality of openings 56 in the second cylindrical housing 54 to then inflate the air bag 40. The filter 52 prevents the residue from the combustion of the propellant 44, which is transported through the first plurality of openings 50 in the first cylindrical housing 48 by the gases resulting from combustion of the propellant 44, from coming into contact with the air bag 40 and possibly the occupant of the vehicle. The air bag 40 has a porosity in the weave (not shown) that, after inflation of the air bag, permit the air bag 40 to absorb energy by deflating and the occupant of the vehicle to then move or exit the vehicle if necessary. The method of assembling the air bag restraint device illustrated in FIG. 2 includes providing fibrous cellulose and combining the cellulose with an oxidizing agent to form a propellant. This step of combining the cellulose with the oxidizing agent to form the propellant can be accomplished according to the method illustrated in FIG. 1 or any other suitable method. The cellulose and oxidizing agent can further be combined with a vitrifying agent, an agent for increasing the gas yield, and/or an agent for increasing the burn rate of the resulting propellant, if desired. For incorporation into the air bag restraint device 34, the propellant is formed into a cylinder that can be contained within the first cylindrical housing 48 and that has a hollow interior within which the igniter 46 can be positioned. The resulting cylindrically shaped propellant 44 and the igniter 46 are than positioned within the first cylindrical housing. The first cylindrical housing 48 and the filter 52 are then positioned within the second cylindrical housing 54. The second cylindrical housing 54 is then attached to the interior surface of the reaction canister 36 and the air bag 40 is attached across the open end 38 of the reaction canister 36 to complete the assembly of the air bag restraint device 34. The air bag restraint device 34 can then be mounted in the dashboard 58 of a vehicle or in any other suitable location.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described herein above is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A method for producing an air bag vehicle restraint device comprising:

providing cellulose;

providing an oxidizing agent;

providing a vitrifying agent;

creating a sheet propellant comprised of said cellulose, said oxidizing agent, and said vitrifying agent;

providing a reaction canister that has an interior space for receiving said sheet propellant and an opening;

positioning said sheet propellant in said interior space of said reaction canister;

placing an igniter adjacent to said sheet propellant;

operatively connecting a filter to said reaction canister so that said filter is located between said opening and said sheet propellant; and operatively attaching an air bag across said opening of said reaction canister.

2. A method, as claimed in claim 1, wherein:

said sheet propellant includes an agent for increasing a burn rate of said sheet propellant upon combustion.

3. A method, as claimed in claim 1, wherein:

said interior space of said reaction canister has a tubular shape; and said step of creating a sheet propellant includes shaping said sheet propellant to substantially conform to said tubular shape of said interior space of said reaction canister.

4. A method, as claimed in claim 1, wherein:

said sheet propellant is flexible;

said interior space of said reaction canister has a tubular shape; and said step of creating a sheet propellant includes rolling said sheet propellant to substantially conform to said tubular shape of said interior space of said reaction canister.

5. A method, as claimed in claim 1, where in:

said step of creating a sheet propellant includes perforating said sheet propellant.

6. A method, as claimed in claim 1, wherein: said sheet propellant has one of the following forms: a board and a flexible sheet.

7. A method, as claimed in claim 1, wherein: said filter includes a mineral felt material.

8. A method, as claimed in claim 1, wherein: said filter has a cylindrical shape.

9. A method, as claimed in claim 1, wherein:

said sheet propellant is flexible;

said interior space of said reaction canister has a cylindrical shape; and said step of creating a sheet propellant includes rolling said sheet propellant to substantially conform to said cylindrical shape of said interior space of said reaction canister and to provide a propellant interior space for receiving said igniter; and said step of positioning an igniter adjacent to said propellant includes positioning said igniter in said propellant interior space.

10. A method, as claimed in claim 1, wherein:

said sheet propellant is flexible;

said interior space of said reaction canister has a defined shape; and said step of creating a sheet propellant includes bending said sheet propellant so as to substantially conform to said defined shape of said interior space of said reaction canister.

11. A method, as claimed in claim 1, wherein:

said sheet propellant is flexible;

said step of creating a sheet propellant includes shaping said sheet propellant into a spiral.

12. The method of claim 1, wherein said cellulose is fibrous cellulose.

13. A method for producing an air bag vehicle restraint device comprising:

providing cellulose;

providing an oxidizing agent;

providing a vitrifying agent;

creating a sheet propellant comprised of said cellulose, said oxidizing agent and said vitrifying agent, said vitrifying agent increasing the viscosity of a residue produced during combustion of the sheet propellant;

providing a reaction canister that has an interior space for receiving said sheet propellant and an opening;

positioning said sheet propellant in said interior space of said reaction canister;

placing an igniter adjacent to said sheet propellant;

operatively connecting a filter to said reaction canister so that said filter is located between said opening and said sheet propellant; and operatively attaching an air bag across said opening of said reaction canister.

14. A method, as claimed in claim 13, wherein:

said oxidizer includes one of the following: an alkali metal nitrate and an alkali metal nitrite.

15. A method, as claimed in claim 13, wherein:

said vitrifying agent includes at least one of the following: aluminum oxide, boric oxide, silicon dioxide, titanium dioxide and a silicate clay.

16. A method, as claimed in claim 13, wherein:

said propellant includes at least one of the following: 1-nitroguanidine, cyanoguanidine, and an alkali azide for increasing gas production.

17. A method, as claimed in claim 13, wherein:

said propellant includes at least one of the following: an alkali metal chlorate and a sulfur compound, for increasing a burn rate of said cellulose.

18. A method, as claimed in claim 13, wherein: said step of creating a sheet propellant includes using one of the following processes: infusion and Fourdrinier.

19. The method of claim 13, wherein said cellulose is fibrous cellulose.

20. A method for producing an air bag vehicle restraint device comprising:

providing cellulose;

providing an oxidizing agent;

providing a vitrifying agent;

creating a sheet propellant comprised of said cellulose said oxidizing agent and said vitrifying agent;

providing a reaction canister that has an interior space with a tubular shape and an opening;

rolling said sheet propellant to fit within said reaction canister;

positioning said sheet propellant in said interior space of said reaction canister;

placing an igniter adjacent to said sheet propellant;

operatively connecting a filter to said reaction canister so that said filter is located between said opening and said sheet propellant; and operatively attaching an air bag across said opening of said reaction canister.

* * * * *